US006692609B2

(12) United States Patent
Kobayashi et al.

(10) Patent No.: US 6,692,609 B2
(45) Date of Patent: Feb. 17, 2004

(54) METHOD FOR MANUFACTURING LAMINATED ELECTRONIC COMPONENT

(75) Inventors: Seiichi Kobayashi, Tamagawa-Mura (JP); Tadayoshi Nagasawa, Tamagawa-Mura (JP); Yutaka Noguchi, Tamagawa-Mura (JP); Hiroyasu Mori, Tamagawa-Mura (JP); Mitsuo Sakakura, Tamagawa-Mura (JP)

(73) Assignee: Toko Kabushiki Kaisha, Tokyo-to (JP)

( * ) Notice: Subject to any disclaimer, the term of this patent is extended or adjusted under 35 U.S.C. 154(b) by 170 days.

(21) Appl. No.: 09/985,379

(22) Filed: Nov. 2, 2001

(65) Prior Publication Data

US 2002/0053128 A1 May 9, 2002

(30) Foreign Application Priority Data

Nov. 6, 2000 (JP) ..... 2000-337481

(51) Int. Cl.[7] ..... H01F 17/00

(52) U.S. Cl. ..... 156/272.8; 156/277; 29/602.1; 427/116; 336/200

(58) Field of Search ..... 156/155, 272.8, 156/277; 29/602.1, 605, 606; 427/116; 336/177, 200; 343/788, 866

(56) References Cited

U.S. PATENT DOCUMENTS 6,459,351 B1 * 10/2002 Maki et al. ..... 336/200

FOREIGN PATENT DOCUMENTS

JP 10027712 A * 1/1998 ..... H01F/17/00

* cited by examiner

*Primary Examiner*—Michael W. Ball
*Assistant Examiner*—John T. Haran
(74) *Attorney, Agent, or Firm*—Pillsbury Winthrop LLP

(57) ABSTRACT

A method for manufacturing a laminated electronic component, in which magnetic layers and conductive patterns for coil are sequentially provided, a coil pattern is enclosed between the magnetic layers inside a laminated body, and a nonmagnetic section is provided between adjacent conductive patterns for coil, the coil pattern being provided by repeatedly performing: a first step of providing a second magnetic layer over the entire top face of a first magnetic layer, which a first conductive pattern for coil is provided on; a second step of providing a loop-shaped groove in the second magnetic layer by using laser processing; a third step of providing a nonmagnetic section in one portion of the loop-shaped groove; and a fourth step of printing a second conductive pattern for coil so that one end section thereof overlaps the end section of the first conductive pattern for coil and the other end section extends to the surface of the nonmagnetic section.

8 Claims, 4 Drawing Sheets

METHOD FOR MANUFACTURING LAMINATED ELECTRONIC COMPONENT

BACKGROUND OF THE INVENTION

1. Field of the Invention

The present invention relates to a method for manufacturing a laminated electronic component wherein magnetic layers and conductive patterns for coil are sequentially provided, a coil pattern is enclosed between the magnetic layers inside a laminated body, and a nonmagnetic section is provided between adjacent conductive patterns for coil.

2. Description of the Related Art

Conventional laminated electronic components include, for example, an inductance element comprising coil patterns enclosed between magnetic layers inside a laminated body, as shown in FIG. 5. This laminated electronic component is made by alternately printing magnetic layers 51 and conductive patterns for coil 52, and connecting the conductive patterns for coil 52 between the magnetic layers so that their tips overlap, forming a coil pattern. In this type of laminated electronic component, the conductive patterns for coil are completely buried in the magnetic material, and for this reason the flow of magnetic flux does not attain an ideal distribution of $\phi 1$ and $\phi 2$, but there is leakage flux as represented by $\phi A$ and $\phi B$. Furthermore, in this laminated electronic component, the direction of current flowing in the conductive patterns for coil, which are adjacent to each other at top and bottom with the magnetic layers therebetween, is reversed, and the direction of the magnetic flux generated by this current is also reversed. Therefore, this type of conventional laminated electronic component has poor magnetic coupling and cannot obtain a large inductance.

To solve such problems, there is a laminated electronic component which is made by alternately printing magnetic layers 61 and conductive patterns for coil 62, connecting the conductive patterns for coil 62 between the magnetic layers so that their tips overlap, thereby forming a coil pattern, and providing nonmagnetic sections 63 between adjacent top and bottom conductive patterns for coil. In this type of laminated electronic component, since the nonmagnetic sections 63 are provided between adjacent top and bottom conductive patterns for coil, any magnetic flux attempting to flow between the adjacent top and bottom conductive patterns for coil is blocked by the nonmagnetic sections, achieving ideal distribution of magnetic flux.

Such a laminated electronic component is manufactured as shown in FIGS. 7A to 7C. Firstly, a conductive pattern for coil 72 is printed on a magnetic layer 71. Next, a magnetic paste is printed on a half-face of the magnetic layer 71 in such a way that the conductive pattern for coil 72 is exposed, and a groove 74 is provided in the magnetic layer 73. Then, a nonmagnetic material is printed in the groove to form a nonmagnetic section 75, and a conductive pattern for coil is printed with its end section overlapping the end section of conductive pattern for coil in the lower layer.

In recent years, laminated electronic components of this type are being miniaturized in line with the miniaturization of the electronic devices which they are mounted in. In view of this, the width of the grooves in such conventional laminated electronic components tend to become narrow when the component is miniaturized, leading to problems that the magnetic paste blots and breaks in the groove at the time of forming the magnetic layer, making it impossible to form the nonmagnetic section. Moreover, since the magnetic layer is provided on each half-face in the conventional laminated electronic component, the unevenness of the printed face increases each time a layer is added, adversely affecting the printing precision of the conductive pattern for coil, the magnetic layer, and the nonmagnetic section.

SUMMARY OF THE INVENTION

It is an object of the present invention to provide a method for manufacturing a laminated electronic component in which a nonmagnetic section can be provided between the conductive patterns for coil, and the printing precision of the conductive patterns for coil and the magnetic layers can be increased, even when the laminated electronic component is miniaturized.

The method for manufacturing laminated electronic component of the present invention achieves the above objects by improving the method of forming grooves in the magnetic layers, the timing of their formation, and their shape.

According to one aspect, the present invention provides a method for manufacturing the laminated electronic component, in which magnetic layers and conductive patterns for coil are sequentially provided, a coil pattern is enclosed between the magnetic layers inside a laminated body, and a nonmagnetic section is provided between adjacent conductive patterns for coil, the coil pattern being provided by repeatedly performing a first step of providing a second magnetic layer over the entire top face of a first magnetic layer, which a first conductive pattern for coil is provided on; a second step of providing a loop-shaped groove in the second magnetic layer by using laser processing; a third step of providing a nonmagnetic section in one portion of the loop-shaped groove; and a fourth step of printing a second conductive pattern for coil so that one end section thereof overlaps the end section of the first conductive pattern for coil and the other end section extends to the surface of the nonmagnetic section.

According to another aspect, the present invention provides a method for manufacturing a laminated electronic component, in which magnetic layers and conductive patterns for coil are sequentially provided, a coil pattern is enclosed between the magnetic layers inside a laminated body, and a nonmagnetic section is provided between adjacent conductive patterns for coil, the coil pattern being provided by repeatedly performing a first step of providing a second magnetic layer over the entire top face of a first magnetic layer, which a first conductive pattern for coil is provided on; a second step of providing a loop-shaped groove in the second magnetic layer by using laser processing; a third step of providing a nonmagnetic section in the loop-shaped groove; and a fourth step of providing a through-hole in the nonmagnetic section at a position corresponding to an end section of the conductive pattern for coil by using laser processing, and printing a conductive pattern for coil on the surface of the nonmagnetic section.

According to another aspect, the present invention provides a method for manufacturing the laminated electronic component, in which magnetic layers and conductive patterns for coil are sequentially provided, a coil pattern is enclosed between the magnetic layers inside a laminated body, and a nonmagnetic section is provided between adjacent conductive patterns for coil, the coil pattern being provided by repeatedly performing a first step of printing a second magnetic layer over the entire top face of a first magnetic layer, which a first conductive pattern for coil is provided on; a second step of providing a loop-shaped groove in the second magnetic layer by using laser processing; a third step of providing a nonmagnetic section in one portion of the loop-shaped groove; and a fourth step of printing a second conductive pattern for coil so that one end section thereof overlaps the end section of the first conductive pattern for coil and the other end section extends to the surface of the nonmagnetic section.

According to another aspect, the present invention provides a method for manufacturing the laminated electronic component, in which magnetic layers and conductive patterns for coil are sequentially provided, a coil pattern is enclosed between the magnetic layers inside a laminated body, and a nonmagnetic section is provided between adjacent conductive patterns for coil, the coil pattern being provided by repeatedly performing a first step of providing a second magnetic layer by laminating magnetic sheets over the top face of a first magnetic layer, which a first conductive pattern for coil is provided on; a second step of providing a loop-shaped groove in the second magnetic layer by using laser processing; a third step of providing a nonmagnetic section in one portion of the loop-shaped groove; and a fourth step of printing a second conductive pattern for coil so that one end section thereof overlaps the end section of the first conductive pattern for coil and the other end section extends to the surface of the nonmagnetic section.

According to the method for manufacturing the laminated electronic component of the present invention, after the second magnetic layer has been provided over the entire top face of the first magnetic layer, which a first conductive pattern for coil is provided on, a loop-shaped groove is provided in the second magnetic layer by laser processing at a position which corresponds to the lamination position of the conductive pattern for coil and a nonmagnetic section. A nonmagnetic section is provided in all or part of the loop-shaped groove by printing a nonmagnetic paste in all or part of the loop-shaped groove. When the nonmagnetic section has been provided in part of the loop-shaped groove, another conductive pattern for coil is printed so that one end section thereof overlaps the end section of the abovementioned conductive pattern for coil, which is exposed at the bottom face of the groove, and the other end section extends to the surface of the nonmagnetic section. When the nonmagnetic section has been provided in the entire loop-shaped groove, a through-hole is provided in the nonmagnetic section at a position corresponding to the end section of the conductive pattern for coil by using laser processing, and a conductive pattern for coil is printed on the surface of the nonmagnetic section. These steps are repeated until a predetermined number of turns is obtained, achieving a coil pattern having a predetermined number of turns inside a laminated body. In the laminated electronic component manufactured in this way, the second magnetic layer is provided over the entire top face of the first magnetic layer, which the first conductive pattern for coil is printed on, prior to providing the loop-shaped groove for forming a nonmagnetic section in the second magnetic layer. Therefore, the face which the mask for printing the nonmagnetic paste and the conductive paste is to be mounted on is made smooth. The groove provided in the second magnetic layer is loop-shaped, and consequently, when the nonmagnetic section is provided in part of the loop-shaped groove, blotting of the nonmagnetic paste and conductive paste is limited to the direction which the groove extends in.

DESCRIPTION OF THE PREFERRED EMBODIMENTS

Embodiments of the method for manufacturing a laminated electronic component according to the present invention will be explained with reference to the FIGS. 1 to 4.

Figure 1A:
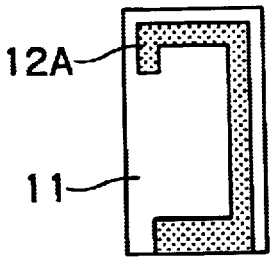
FIGS. 1A to 1I are top views of a first embodiment of the method for manufacturing a laminated electronic component according to the present invention.
Figure 4:
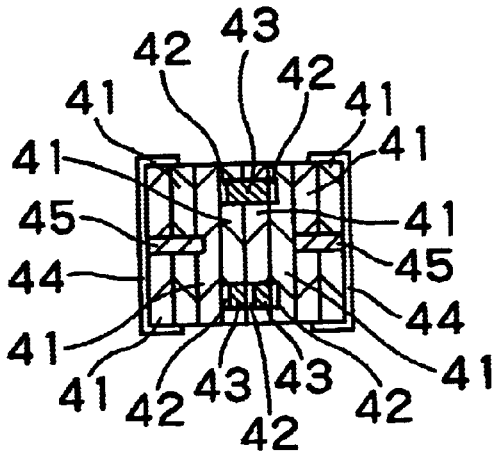
FIG. 4 is a cross-sectional view of another laminated electronic component according to the present invention.
Figure 5:
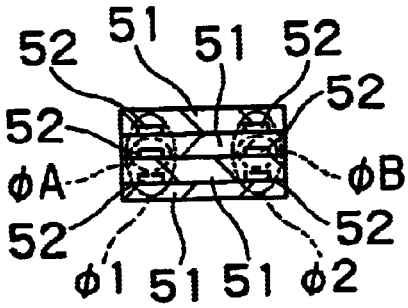
FIG. 5 (PRIOR ART)
FIG. 5 is a cross-sectional view of a conventional laminated electronic component.

FIG. 1 is a top view of a first embodiment of the method for manufacturing a laminated electronic component according to the present invention; FIG. 2 is a cross-sectional view of a laminated electronic component according to the present invention; FIG. 3 is a top view of a second embodiment of the method for manufacturing of a laminated electronic component according to the present invention; and FIG. 4 is a cross-sectional view of another laminated electronic component according to the present invention.

As for example shown in FIG. 2, the laminated electronic component according to the present invention comprises sequentially-provided magnetic layers 21 and conductive patterns for coil 22; a coil pattern encloses the magnetic layers inside a laminated body, the axis of the coil pattern being vertical to the mount face, and nonmagnetic sections 23 are provided between adjacent conductive patterns for coil 22. Both ends of the coil pattern connect to external electrodes 24, which are provided to the laminated body.

The coil pattern of the laminated electronic component is formed as follows. Firstly, as shown in FIG. 1A, a conductive pattern for coil 12A is printed on the surface of a magnetic layer 11. The magnetic layer 11 comprises a ferrite. The conductive pattern for coil comprises a conductor of silver, nickel, silver palladium, copper, or the like, arranged into a paste-like shape, and in FIG. 1A is printed over one half-turn portion.

Figure 1B:
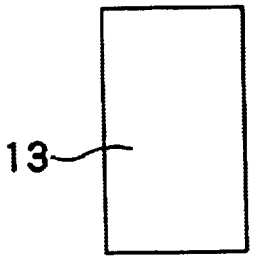
Figure 2:
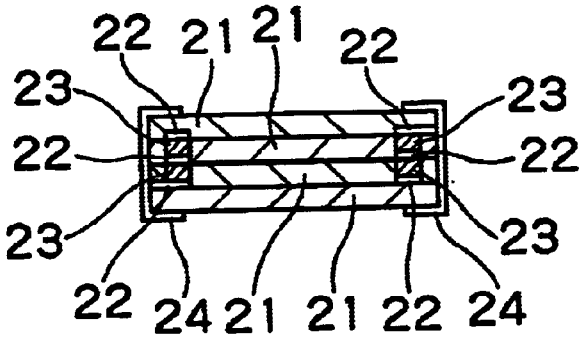
FIG. 2 is a cross-sectional view of a laminated electronic component according to the present invention.

Next, as shown in FIG. 1B, a magnetic layer 13 is provided over the entire surface of the magnetic layer which the conductive pattern for coil is printed on. The magnetic layer 13 is made by printing a paste-like layer of ferrite over the entire surface of the magnetic layer 11, or by laminating magnetic sheets over the surface of the magnetic layer 11.

Figure 1C:
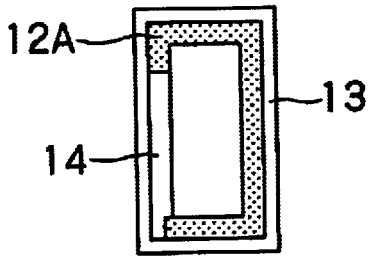

Then, as shown in FIG. 1C, a loop-shaped groove 14 is provided in the magnetic layer 13 by laser processing. The loop-shaped groove 14 is provided by radiating laser beam in a loop-shape onto the magnetic layer 13 along the position where the conductive pattern for coil and the nonmagnetic section are laminated, processing into a loop-shape the portion of the magnetic layer 13 where the laser beam has been radiated. The conductive pattern for coil 12A is exposed at the bottom face of the groove 14. In FIG. 1C, since the conductive pattern for coil 12A comprises less than one-turn portion of the one end section side of the coil pattern, the magnetic layer 11 is exposed at one part of the groove.

Figure 1D:
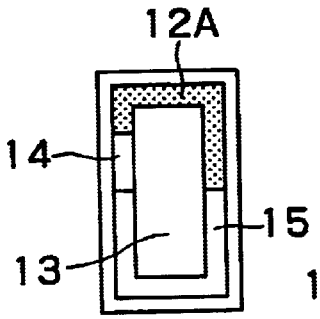

Then, as shown in FIG. 1D, a nonmagnetic section 15 comprises a nonmagnetic material arranged into a paste-like shape, and is printed in one portion of the loop-shaped groove 14 (a half-turn portion of the loop in FIG. 1D) so that the end section of the conductive pattern for coil 12A is exposed. The surface of the nonmagnetic section 15 is substantially the same height as the surface of the magnetic layer 13.

Figure 1E:
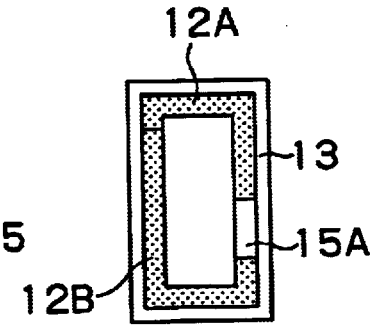

Then, as shown in FIG. 1E, a conductive pattern for coil 12B is printed on the surface of the nonmagnetic section so that one end section thereof overlaps with the end section of the conductive pattern for coil 12A and the other end extends to the surface of the nonmagnetic section 15. In this case, a part 15A of the nonmagnetic section is not covered by the conductive pattern for coil and remains exposed.

Figure 1F:
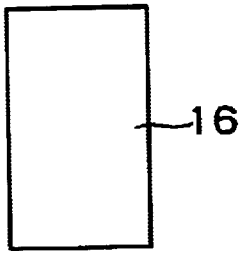

As shown in FIG. 1F, a magnetic layer 16 is provided over the entire surface of the magnetic layer which the conductive pattern for coil has been provided on. The magnetic layer 16 is made by printing a paste-like layer of ferrite, or by laminating magnetic sheets.

Figure 1G:
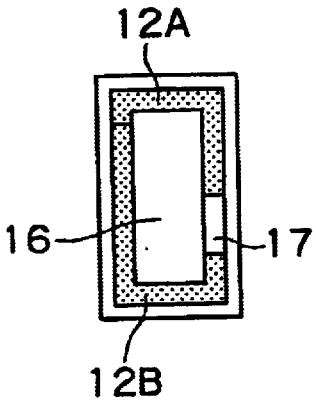

Next, as shown in FIG. 1G, a loop-shaped groove 17 is provided in the magnetic layer 16 by laser processing. The groove 17 is provided by radiating laser beam in a loop-shape onto the magnetic layer 16 along the position where the conductive pattern for coil and the nonmagnetic section are laminated, removing the position where the conductive pattern for coil and the nonmagnetic section are laminated into a loop-shape. The conductive patterns for coil 12A and 12B and the part 15A of the nonmagnetic section are exposed at the bottom face of the groove 17.

Figure 1H:
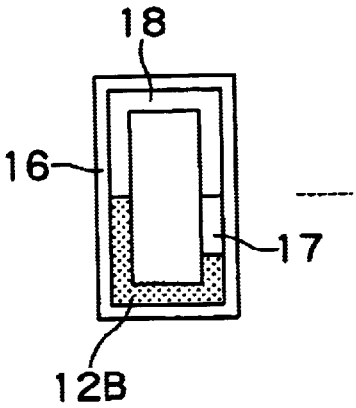

Then, as shown in FIG. 1H, a nonmagnetic section 18 is provided in the loop-shaped groove 17. The nonmagnetic section 18 is provided by printing a nonmagnetic paste in one portion of the groove 17 (the remaining half-turn portion of the loop in FIG. 1H) so that the end section of the other end of the conductive pattern for coil 12B is exposed. The surface of the nonmagnetic section 18 is substantially the same height as the surface of the magnetic layer 16.

Figure 1I:
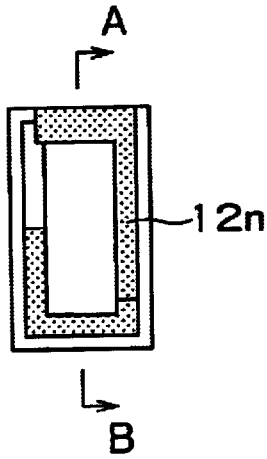

Following these processes, the steps of printing the conductive pattern for coil, providing the magnetic layer, providing the loop-shaped groove in the magnetic layer by laser processing, and providing a nonmagnetic section in the groove, are repeated a predetermined number of times, and lastly a conductive pattern for coil 12*n* is printed to obtain the coil pattern having a predetermined turn as shown in FIG. 1I. In the coil pattern obtained in this way, the nonmagnetic sections are providing between adjacent conductive patterns for coil.

Incidentally, the kind of the laser, which is used in laser processing for providing the loop-shaped grooves in the magnetic layers, selecting one which is well-suited for processing magnetic layers and less suited for processing nonmagnetic sections and conductive patterns for coil (e.g. a YAG laser), and consequently, the processing of the loop-shaped groove can be improved.

FIG. 4 shows another laminated electronic component according to the present invention, which comprises sequentially-provided magnetic layers 41 and conductive patterns for coil 42; a coil pattern encloses the magnetic layers inside a laminated body, the axis of the coil pattern being parallel to the mount face, and nonmagnetic sections 43 are provided between adjacent conductive patterns for coil 42. Leader electrodes 45 are provided at both end sections of the laminated body, and connect both ends of the coil pattern to external electrodes 44, which are provided on both ends of the laminated body.

Figure 3A:
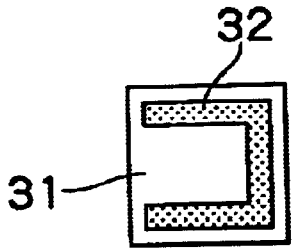
FIGS. 3A to 3K are top views of a second embodiment of the method for manufacturing a laminated electronic component according to the present invention.

The coil pattern of the laminated electronic component is formed as follows. Firstly, as shown in FIG. 3A, a conductive pattern for coil 32 is printed on the surface of a magnetic layer 31. The magnetic layer 31 comprises a ferrite. The conductive pattern for coil 32 comprises a conductor of silver, nickel, silver palladium, copper, or the like, arranged into a paste-like shape, and in FIG. 3A is printed over a three-quarter turn portion. In the laminated electronic component of FIG. 4, the magnetic layer 31 is provided over the layer of magnetic ceramic, where the leader electrodes are provided, and over the entire surface of the laminated body, where the leader electrodes are provided, and through-holes for connecting to the leader electrodes are provided at predetermined positions of the magnetic layer 31; the conductive pattern for coil is printed on the magnetic layer to obtain one end of the coil pattern.

Figure 3B:
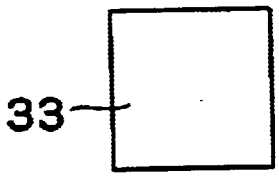

Next, as shown in FIG. 3B, a magnetic layer 33 is provided over the entire surface of the magnetic layer which the conductive pattern for coil is printed on. The magnetic layer 33 is made by printing a paste-like layer of ferrite over the entire surface of the magnetic layer 31, or by laminating magnetic sheets over the surface of the magnetic layer 31.

Figure 3C:
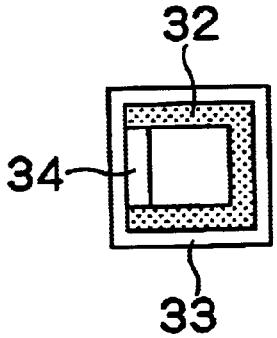

Then, as shown in FIG. 3C, a loop-shaped groove 34 is provided in the magnetic layer 33 by laser processing. The groove 34 is provided by radiating laser beam in a loop-shape onto the magnetic layer 33 along the position where the conductive pattern for coil and the nonmagnetic section are laminated, processing into a loop shape the portion of the magnetic layer 33 where the laser beam has been radiated. The conductive pattern for coil 32 is exposed at the bottom face of the groove 34. In FIG. 3C, since the conductive pattern for coil 32 comprises less than one-turn portion of the one end side of the coil pattern, the magnetic layer 31 is exposed at one part of the groove.

Figure 3D:
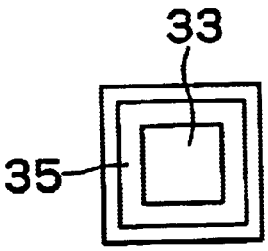

Then, as shown in FIG. 3D, a nonmagnetic section 35 comprises a nonmagnetic material arranged into a paste-like shape, and is printed in one portion of the groove 34 so that the surface of the nonmagnetic section 35 is the same height as the surface of the magnetic section 33.

Figure 3E:
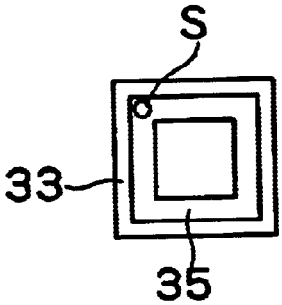

Then, as shown in FIG. 3E, a through-hole S is provided at a position corresponding to the end section of the lower conductive pattern for coil in the nonmagnetic section 35. The through-hole S is provided by laser processing.

Figure 3F:
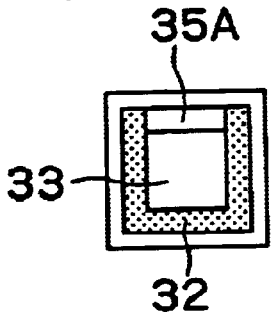

As shown in FIG. 3F, a conductive pattern for coil 32 is printed on the surface of the nonmagnetic section 35. One end of the conductive pattern for coil 32 is opposite to the other end of the conductive pattern for coil on the lower layer. At this time, a part 35A of the nonmagnetic section is not covered by the conductive pattern for coil and remains exposed.

The one end of the conductive pattern for coil 32 and the other end of the conductive pattern for coil on lower layer are connected together by conductor in through-hole.

Figure 3G:
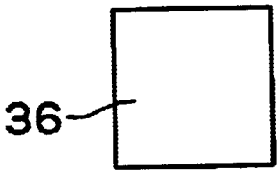

As shown in FIG. 3G, a magnetic layer 36 is provided over the entire surface of the magnetic layer which the conductive pattern for coil has been provided on. The magnetic layer 36 is made by printing a paste-like layer of ferrite, or by laminating magnetic sheets.

Figure 3H:
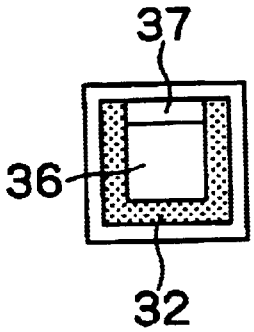

Next, as shown in FIG. 3H, a loop-shaped groove 37 is provided in the magnetic layer 36 by laser processing. The groove 37 is provided by radiating laser beam in a loop-shape onto the magnetic layer 36 along the position where the conductive pattern for coil and the nonmagnetic section are laminated, processing the magnetic layer 36 in a loop-shape. The conductive pattern for coil 32 is exposed at the bottom face of the groove 37. The part 35A of the nonmagnetic section is also exposed in part of the groove 37.

Figure 3I:
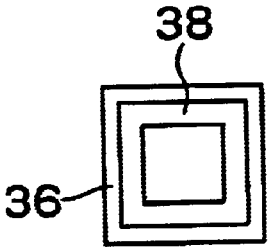
Figure 3J:
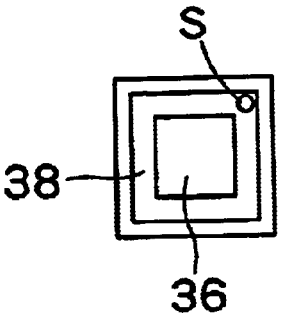

Then, as shown in FIG. 3I, a nonmagnetic section 38 is provided by printing a nonmagnetic paste in all of the groove 37 so that the surface of the nonmagnetic section 38 is the same height as the surface of the magnetic layer 36. Thereafter, as shown in FIG. 3J, a through-hole S is provided at a position corresponding to the end section of the lower conductive pattern for coil in the nonmagnetic section 38. The through-hole S is provided by laser processing.

Figure 3K:
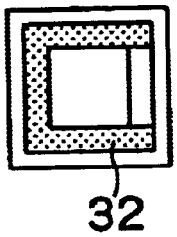
Figure 6:
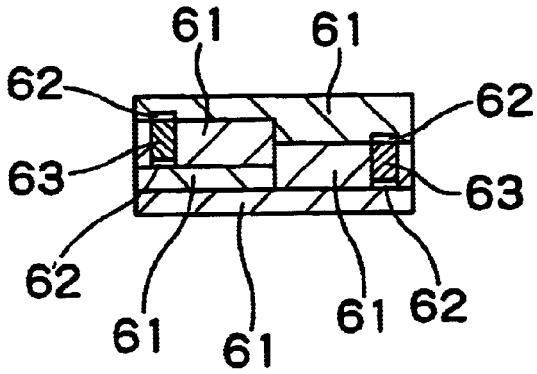
FIG. 6 (PRIOR ART)
FIG. 6 is a cross-sectional view of another conventional laminated electronic component.
Figure 7A:
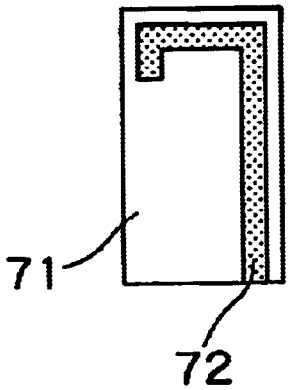
FIG. 7A (PRIOR ART)
FIGS. 7A to 7C are top views of a conventional method for manufacturing a laminated electronic component.
Figure 7B:
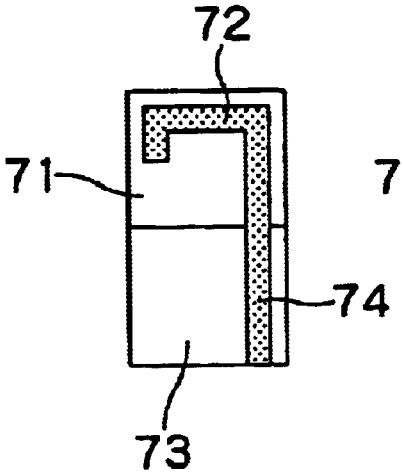
FIG. 7B (PRIOR ART)
Figure 7C:
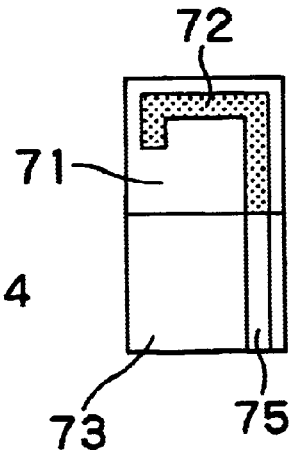
FIG. 7C (PRIOR ART)

Following these processes, the steps of printing the conductive pattern for coil, providing the magnetic layer, providing the loop-shaped groove in the magnetic layer by laser processing, providing a nonmagnetic section in the groove, and providing the through-hole in the non-magnetic section by laser processing, are repeated a predetermined number of times, and lastly a conductive pattern for coil 32 is printed to obtain the coil pattern having a predetermined turn as shown in FIG. 3K. In the laminated electronic component of FIG. 4, a laminated body or the layer of magnetic ceramic, which the leader electrode is provided on, are laminated on the surface of the magnetic layer where the other end of the coil pattern is provided, and the external electrodes are provided at both ends (the faces which are perpendicular to the lamination direction of the magnetic layers in the laminated body).

The method for manufacturing the laminated electronic component according to the present invention is not limited to the embodiments described above. For example, the nonmagnetic section may be provided so that its surface is lower than the surface of the magnetic layer, and the conductive pattern for coil may be printed in the resultant dip. In this case, the printing precision of the conductive pattern for coil can be increased to a higher level than in any of the embodiments described above. Further, in the first embodiment, the nonmagnetic section is provided in a half-turn portion of the loop-shaped groove, but the nonmagnetic section need only be provided so as to expose the end section of the conductive pattern for coil, and the extent of its formation in the groove can be adjusted in accordance with the number of turns in the conductive pattern for coil. Moreover, although the first embodiment describes the manufacture of the laminated electronic component shown in FIG. 2, it can also be applied in manufacturing the laminated electronic component shown in FIG. 4. In this case, instead of leading both ends of the coil pattern to the side faces of the magnetic layer, it is acceptable to laminate the layers of magnetic ceramic or the laminated body, where leader electrodes are provided at both ends of the coil pattern, and to provide external electrodes at both ends of these laminated bodies. Moreover, although the second embodiment describes the manufacture of the laminated electronic component shown in FIG. 4, it can also be applied in manufacturing the laminated electronic component shown in FIG. 2. In this case, both ends of the coil pattern should be led to the side faces of the magnetic layer, and connected to external electrodes, provided at faces which are parallel to the lamination direction of the magnetic layers in the laminated body.

The method for manufacturing the laminated electronic component according to the present invention can also be applied in manufacturing a transformer comprising two or more coil patterns in a laminated body, and a functional circuit comprising a coil pattern and a capacitor element in a laminated body.

The method for manufacturing the laminated electronic component according to the present invention described above comprises making a coil pattern, enclosed between magnetic layers in a laminated body, by repeatedly performing a first step of providing a second magnetic layer over the entire top face of a first magnetic layer, which a first conductive pattern for coil is provided on, a second step of providing a loop-shaped groove in the second magnetic layer by using laser processing, a third step of providing a nonmagnetic section in one portion of the loop-shaped groove, and a fourth step of printing a second conductive pattern for coil so that one end section thereof overlaps the end section of the first conductive pattern for coil and the other end section extends to the surface of the nonmagnetic section, the nonmagnetic sections being positioned between adjacent conductive patterns for coil. Therefore, the print faces can be made smooth, the blotting directions of the nonmagnetic sections and conductive patterns for coil can be minimized, and connections between the conductive patterns for coil can be made accurate.

Further, the method for manufacturing the laminated electronic component according to the present invention comprises making a coil pattern, enclosed between magnetic layers in a laminated body, by repeatedly performing a first step of providing a second magnetic layer over the entire top face of a first magnetic layer, which a first conductive pattern for coil is provided on, a second step of providing a loop-shaped groove in the second magnetic layer by using laser processing, a third step of providing a nonmagnetic section in the loop-shaped groove, and a fourth step of providing a through-hole in the nonmagnetic section at a position corresponding to the end section of the first conductive pattern for coil by using laser processing, and printing a second conductive pattern for coil on the surface of the nonmagnetic section, so that the nonmagnetic sections are positioned between adjacent conductive patterns for coil. Therefore, the print faces can be made smooth, and connections between the conductive patterns for coil can be made accurate.

Therefore, according to the method for manufacturing the laminated electronic component according to the present invention, even when the shape of the laminated electronic component is miniaturized, the nonmagnetic sections can be provided between adjacent conductive patterns for coil and the printing precision of the conductive patterns for coil and magnetic layers can be increased.

What is claimed is:

1. A method for manufacturing a laminated electronic component, in which magnetic layers and conductive patterns for a coil are sequentially provided, a coil pattern is enclosed between the magnetic layers inside a laminated body, and a nonmagnetic section is provided between adjacent conductive patterns for the coil, the coil pattern being provided by repeatedly performing:

a first step of providing a second magnetic layer over the entire top face of a first magnetic layer, which a first conductive pattern for the coil is provided on;

a second step of providing a loop-shaped groove in the second magnetic layer by using laser processing;

a third step of providing a nonmagnetic section in one portion of the loop-shaped groove; and a fourth step of printing a second conductive pattern for the coil so that one end section thereof overlaps the end section of the first conductive pattern for the coil and the other end section extends to the surface of the nonmagnetic section.

2. The method for manufacturing the laminated electronic component according to claim 1, wherein, in said first step, the second magnetic layer is provided by printing.

3. The method for manufacturing the laminated electronic component according to claim 1, wherein, in said first step, the second magnetic layer is provided by laminating magnetic sheets.

4. The method for manufacturing a laminated electronic component according to claim 1, wherein, in said second step, the loop-shaped groove is provided in the second magnetic layer at a position which corresponds to the conductive pattern for the coil provided in the first magnetic layer.

5. A method for manufacturing a laminated electronic component, in which magnetic layers and conductive patterns for a coil are sequentially provided, a coil pattern is enclosed between the magnetic layers inside a laminated body, and a nonmagnetic section is provided between adjacent conductive patterns for coil, the the coil pattern being provided by repeatedly performing:

a first step of providing a second magnetic layer over the entire top face of a first magnetic layer, which a first conductive pattern for the coil is provided on;

a second step of providing a loop-shaped groove in the second magnetic layer by using laser processing;

a third step of providing a nonmagnetic section in one portion of the loop-shaped groove; and a fourth step of providing a through-hole in the nonmagnetic section at a position corresponding to an end section of the first conductive pattern for the coil by using laser processing, and printing a conductive pattern for the coil on the surface of the nonmagnetic section.

6. The method for manufacturing the laminated electronic component according to claim 5, wherein, in said first step, the second magnetic layer is provided by printing.

7. The method for manufacturing the laminated electronic component according to claim 5, wherein, in said first step, the second magnetic layer is provided by laminating magnetic sheets.

8. The method for manufacturing a laminated electronic component according to claim 5, wherein, in said second step, the loop-shaped groove is provided in the second magnetic layer at a position which corresponds to the conductive pattern for the coil provided in the fist magnetic layer.

* * * * *